US007260936B2

(12) United States Patent
Patel et al.

(10) Patent No.: US 7,260,936 B2
(45) Date of Patent: Aug. 28, 2007

(54) COMBUSTOR HAVING MEANS FOR DIRECTING AIR INTO THE COMBUSTION CHAMBER IN A SPIRAL PATTERN

(75) Inventors: Bhawan Bhai Patel, Mississauga (CA); Oleg Morenko, Mississauga (CA); Parthasarathy Sampath, Mississauga (CA); Honza Stastny, Georgetown (CA); Jian-Ming Zhou, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 310 days.

(21) Appl. No.: 10/927,516

(22) Filed: Aug. 27, 2004

(65) Prior Publication Data

US 2006/0042263 A1 Mar. 2, 2006

(51) Int. Cl.
*F02C 1/00* (2006.01)
*F02G 3/00* (2006.01)

(52) U.S. Cl. ..... 60/752; 60/754

(58) Field of Classification Search ..... 60/752–760
See application file for complete search history.

(56) References Cited

U.S. PATENT DOCUMENTS

| | | | | | |
|---|---|---|---|---|---|
| 2,669,090 | A | | 2/1954 | Jackson | |
| 2,840,989 | A | | 7/1958 | MacCautay | |
| 3,169,367 | A | | 2/1965 | Hussey | |
| 3,608,309 | A | | 9/1971 | Hill et al. | |
| 4,226,088 | A | * | 10/1980 | Tsukahara et al. | 60/752 |
| 4,246,757 | A | | 1/1981 | Heberling | |
| 4,475,344 | A | | 10/1984 | Mumford et al. | |
| 4,590,769 | A | | 5/1986 | Lohmann et al. | |
| 4,702,073 | A | | 10/1987 | Melconian | |
| 5,012,645 | A | * | 5/1991 | Reynolds | 60/754 |
| 5,129,231 | A | | 7/1992 | Becker et al. | |
| 5,165,226 | A | | 11/1992 | Newton et al. | |
| 5,237,813 | A | * | 8/1993 | Harris et al. | 60/804 |
| 5,307,637 | A | | 5/1994 | Stickles et al. | |
| 5,398,509 | A | | 3/1995 | North et al. | |
| 5,490,389 | A | * | 2/1996 | Harrison et al. | 60/737 |
| 5,509,270 | A | * | 4/1996 | Pearce et al. | 60/740 |
| 5,590,531 | A | | 1/1997 | Desaulty et al. | |
| 5,941,076 | A | * | 8/1999 | Sandelis | 60/752 |
| 5,956,955 | A | * | 9/1999 | Schmid | 60/748 |
| 5,974,805 | A | * | 11/1999 | Allen | 60/740 |
| 6,079,199 | A | * | 6/2000 | McCaldon et al. | 60/800 |
| 6,155,056 | A | * | 12/2000 | Sampath et al. | 60/756 |
| 6,427,446 | B1 | | 8/2002 | Kraft et al. | |
| 6,497,105 | B1 | * | 12/2002 | Stastny | 60/796 |
| 6,546,733 | B2 | * | 4/2003 | North et al. | 60/772 |
| 6,735,950 | B1 | * | 5/2004 | Howell et al. | 60/748 |
| 2003/0061815 | A1 | * | 4/2003 | Young et al. | 60/748 |
| 2003/0213249 | A1 | | 11/2003 | Pacheco-Tougas et al. | |
| 2006/0042257 | A1 | * | 3/2006 | Stastny | 60/772 |
| 2006/0042271 | A1 | * | 3/2006 | Morenko et al. | 60/804 |

* cited by examiner

*Primary Examiner*—William H. Rodriguez
(74) *Attorney, Agent, or Firm*—Ogilvy Renault LLP

(57) ABSTRACT

A gas turbine engine combustor includes a liner having a dome portion with a plurality of openings defined therein for receiving fuel nozzles and a plurality of holes defined around each opening. The holes directing air into the combustion chamber in a spiral pattern around an axis along which fuel is injected into the combustor by the fuel nozzles.

18 Claims, 6 Drawing Sheets

COMBUSTOR HAVING MEANS FOR DIRECTING AIR INTO THE COMBUSTION CHAMBER IN A SPIRAL PATTERN

TECHNICAL FIELD

The present invention relates generally to gas turbine engine combustors and, more particularly, to a low cost combustor configuration having improved performance.

BACKGROUND OF THE ART

Gas turbine combustors are the subject of continual improvement, to provide better cooling, better mixing, better fuel efficiency, better performance, etc. at a lower cost. Also, a new generation of very small gas turbine engines is emerging (i.e. a fan diameter of 20 inches or less, with about 2500 lbs. thrust or less), however larger designs cannot simply be scaled-down, since many physical parameters do not scale linearly, or at all, with size (droplet size, drag coefficients, manufacturing tolerances, etc.). There is, therefore, a continuing need for improvements in gas turbine combustor design.

SUMMARY OF THE INVENTION

In accordance with the present invention there is provided a gas turbine engine combustor comprising a liner enclosing a combustion chamber, the liner including a dome portion at an upstream end thereof, the dome portion having defined therein a plurality of openings each adapted to receive a fuel nozzle and a plurality of holes defined around each opening, each opening having an axis generally aligned with an fuel injection axis of a fuel nozzle received by the opening, the holes adapted to direct air into the combustion chamber in a spiral around the axis of an associated one of said openings.

In accordance with another aspect there is also provided a gas turbine engine combustor comprising a liner enclosing a combustion chamber, the liner having defined therein a plurality of openings each adapted to receive a fuel nozzle for directing fuel into the combustion chamber generally along an axis of the opening, the liner also having means associated with each opening for directing air into the combustion chamber in a spiral pattern around an axis of the associated opening.

In accordance with another aspect there is also provided a method of combusting fuel in a gas turbine combustor, the method comprising the steps of injecting a mixture of fuel and air into the combustor along an axis, igniting the mixture to create at least one combustion zone in which the mixture is combusted, and directing air into the combustor around said axis in a spiral pattern;

Further details of these and other aspects of the present invention will be apparent from the detailed description and Figures included below.

DESCRIPTION OF THE DRAWINGS

Reference is now made to the accompanying Figures depicting aspects of the present invention, in which.

DETAILED DESCRIPTION OF PREFERRED EMBODIMENTS

Figure 1:
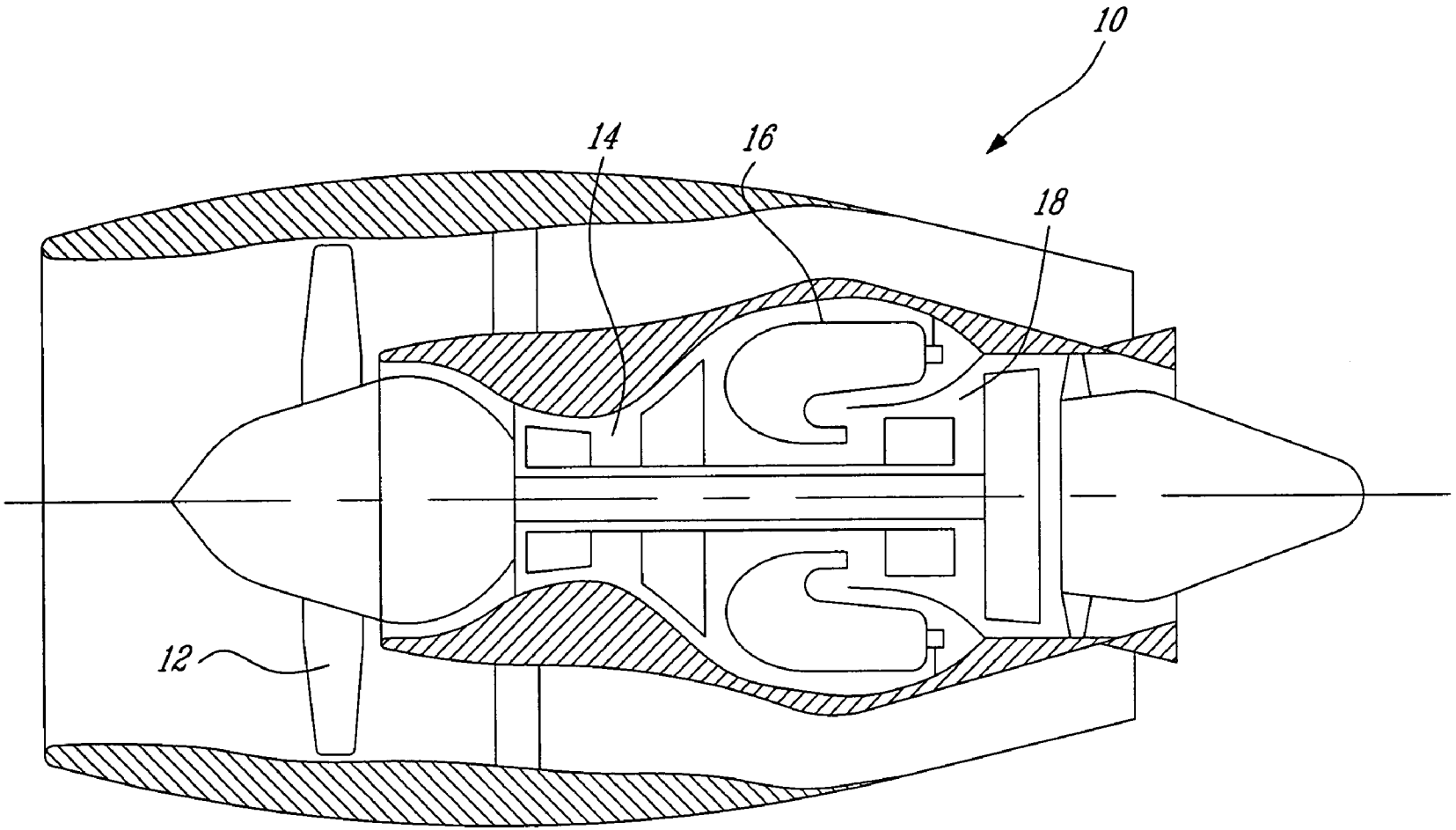
FIG. 1 shows a schematic cross-section of a turbofan engine having an annular combustor.

FIG. 1 illustrates a gas turbine engine 10 preferably of a type provided for use in subsonic flight, generally comprising in serial flow communication a fan 12 through which ambient air is propelled, a multistage compressor 14 for pressurizing the air, an annular combustor 16 in which compressed air is mixed with fuel and ignited for generating an annular stream of hot combustion gases which is then redirected by combustor 16 to a turbine section 18 for extracting energy from the combustion gases.

Figure 2:
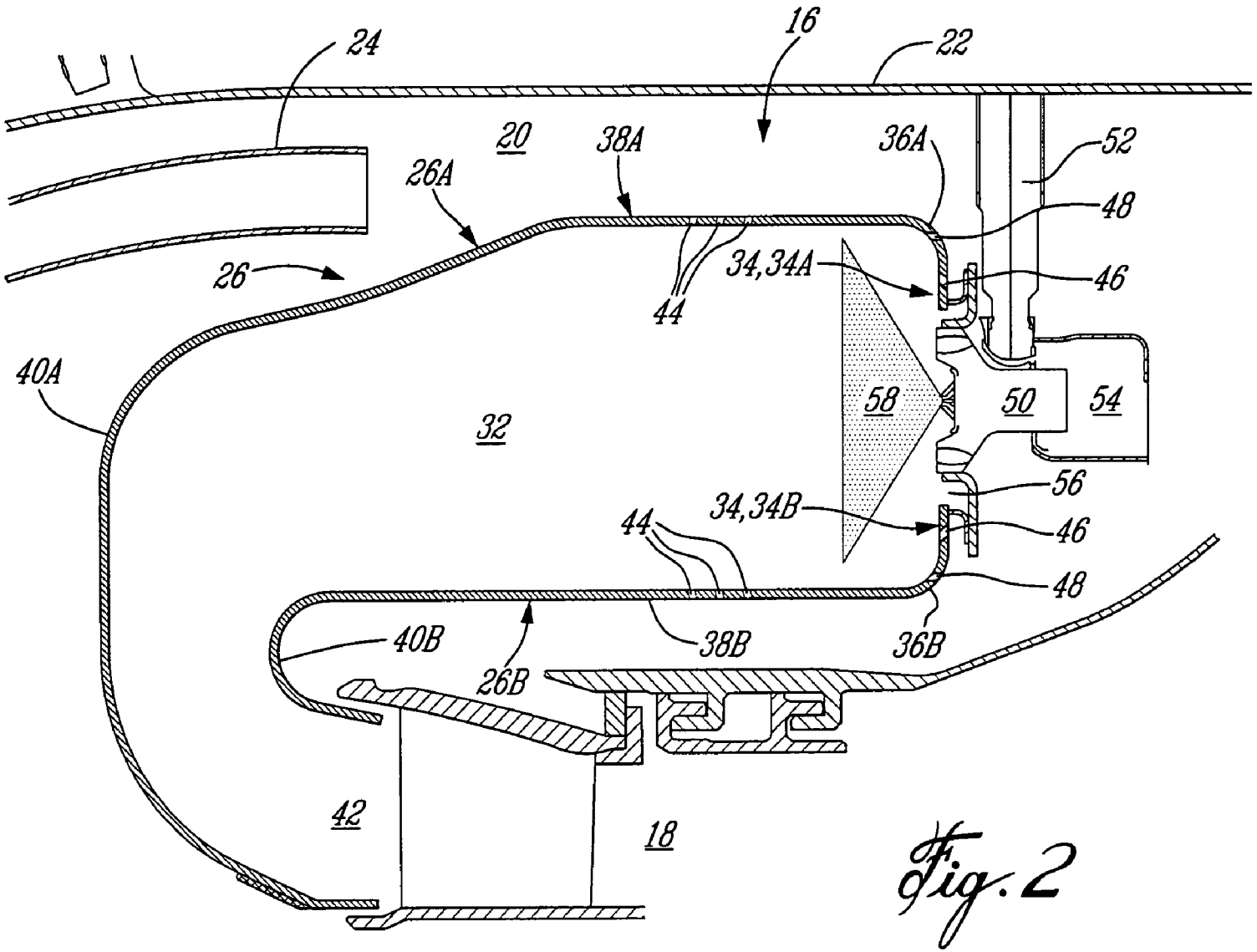
FIG. 2 shows an enlarged view of the combustor of FIG. 1.

Referring to FIG. 2, the combustor 16 is housed in a plenum 20 defined partially by a gas generator case 22 and supplied with compressed air from compressor 14 by a diffuser 24. Combustor 16 comprises generally a liner 26 composed of an outer liner 26A and an inner liner 26B defining a combustion chamber 32 therein. Combustor 16 preferably has a generally flat dome 34, as will be described in more detail below. Outer liner 26A includes a outer dome panel portion 34A, a relatively small radius transition portion 36A, a cylindrical body panel portion 38A, long exit duct portion 40A, while inner liner 26B includes an inner dome panel portion 34B, a relatively small radius transition portion 36B, a cylindrical body panel portion 38B, and a small exit duct portion 40B. The exit ducts 40A and 40B together define a combustor exit 42 for communicating with turbine section 18. The combustor liner 26 is preferably sheet metal. A plurality of holes 44 are provided in liner 26, a plurality of holes 46 an 46' (see FIG. 4) are provided in dome 34, and a plurality of holes 48 are provided in transitions 36, as will be described further below.

A plurality of air-guided fuel nozzles 50, having supports 52 and supplied with fuel from internal manifold 54, communicate with the combustion chamber 32 through nozzle openings 56 to deliver a fuel-air mixture 58 to the chamber 32. As depicted in FIG. 2, the fuel-air mixture is delivered in a cone-shaped spray pattern, and therefore referred to in this application as fuel spray cone 58.

In use, high-speed compressed air enters plenum 20 from diffuser 24. The air circulates around combustor 16, as will be discussed in more detail below, and eventually enters combustion chamber 32 through a plurality of holes 44 in liner 26, holes 46 and 46' in dome 34, and holes 48 in transition 36. Once inside the combustor 16, the air is mixed with fuel and ignited for combustion. Combustion gases are then exhausted through exit 42 to turbine section 18.

Figure 3:
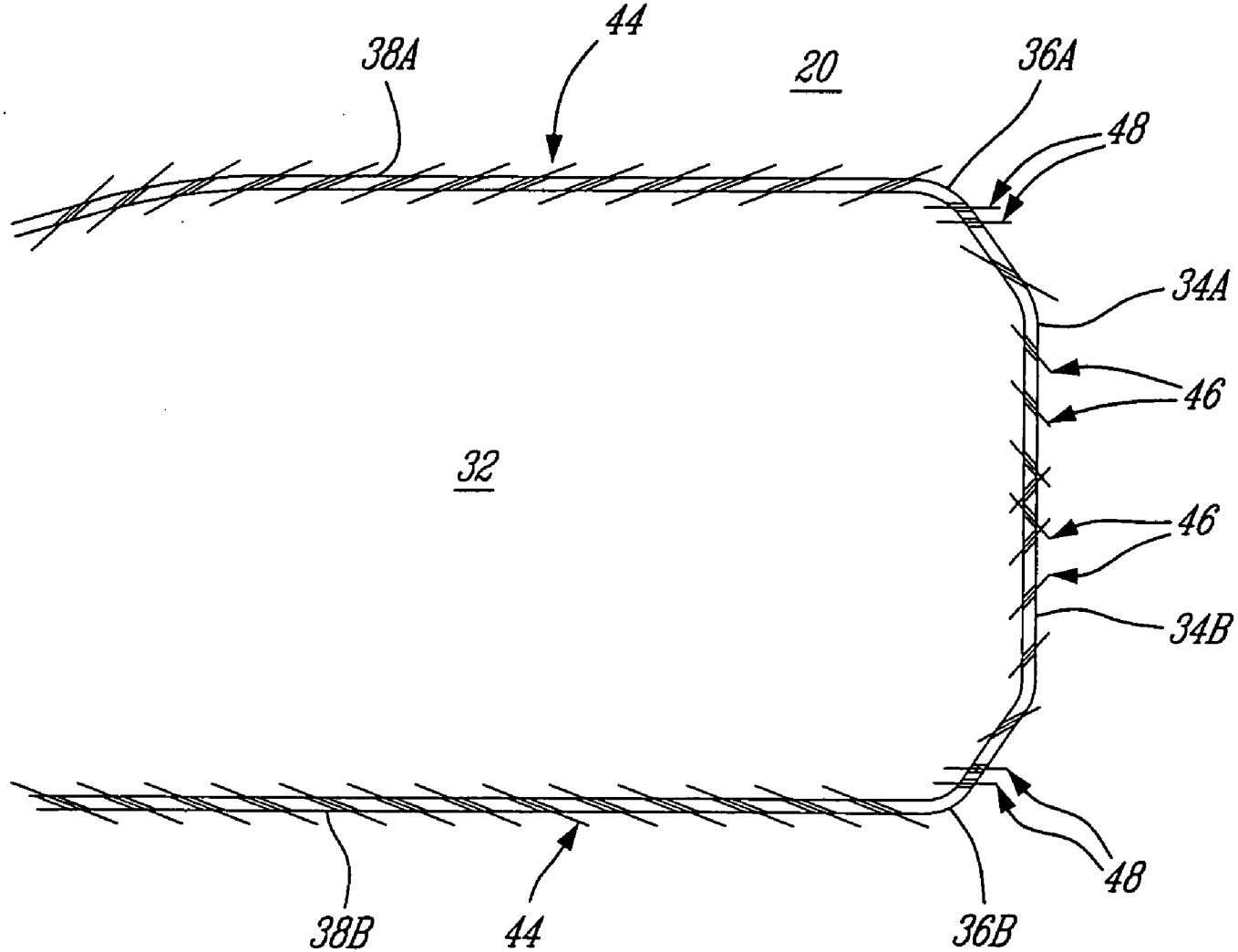
FIG. 3 shows an enlarged view of an alternate embodiment of a combustor of the present invention, schematically depicting a subset of the holes which may be provided therein.

Referring to FIG. 3, as mentioned combustor 16 has holes 44, 46 and 48 therein (represented schematically in this Figure by the indication of their centrelines only) provided for cooling of the liner 26. (For clarity of explanation, holes 46' will be temporarily ignored.) It will be understood that effusion cooling is often achieved by directing air though angled holes in a combustor liner. Therefore, holes 46 in dome panel 34 are angled outwardly away from nozzle 50, while holes 44 are angled downstream in the combustor. Holes 48 in transition portions 36A,B are provided generally parallelly to body panel portion 38A,B to direct cooling air in a louver-like fashion along the interior of body panel portions 38A,B to cool them. It will be noted in this embodiment that transition portions 36A,B are frustoconical with relatively small radii connections to their respective dome and body panels.

Figure 4:
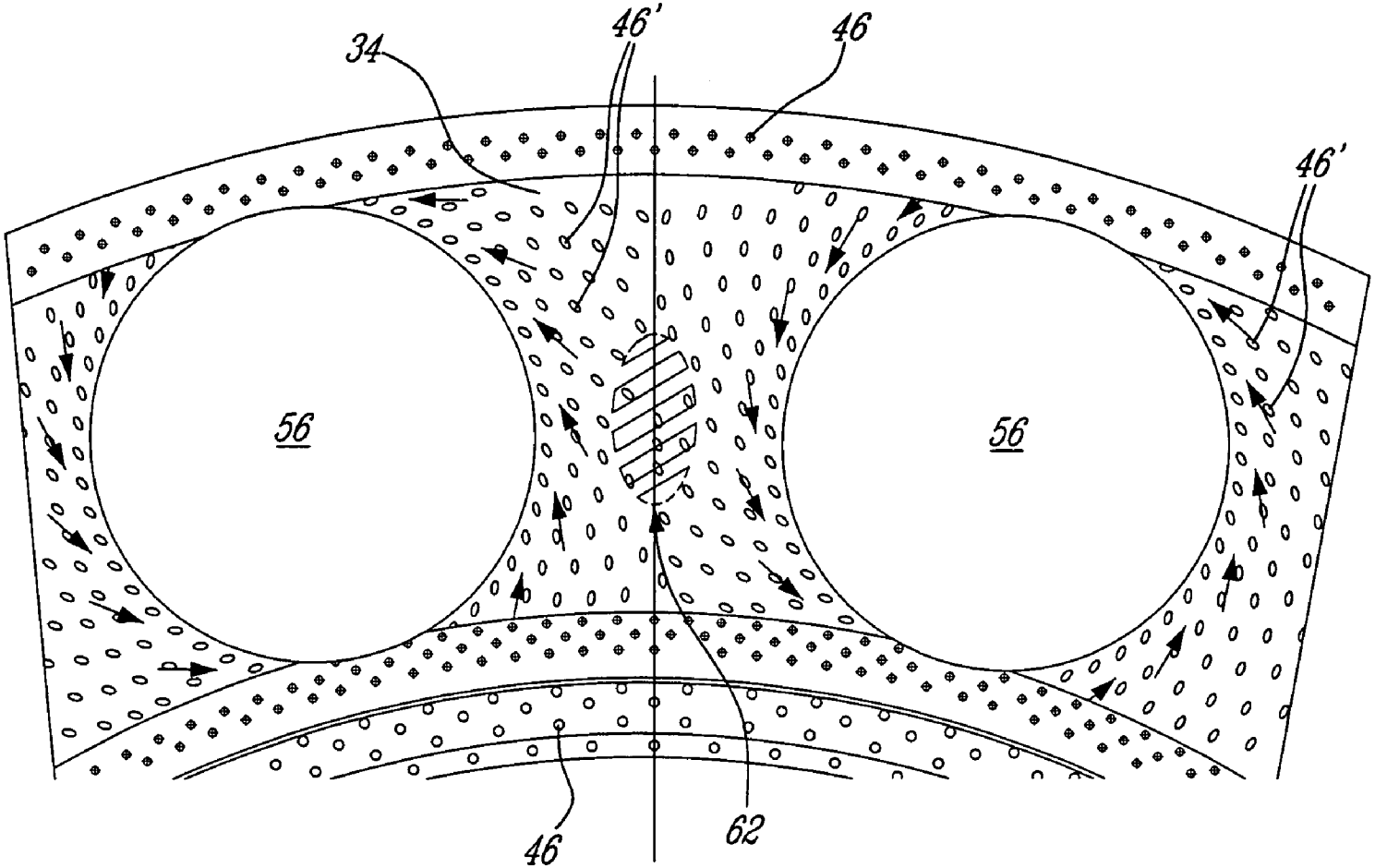
FIG. 4 shows an inside end view of the dome of the combustor of FIG. 2.

Referring now to FIG. 4, holes 46 in dome panels 34A,B, include holes 46', which provided preferably in a concentric circular configuration around nozzle opening 56 and angled generally tangentially relative to an associated opening 56 to deliver air in a circular or helical pattern around opening 56. The entry/exit angle of holes 46' is indicated by the arrows in FIG. 4, and is noted to be generally tangential to opening 56 when viewed in this plane. The patterns of holes 46' around openings 56 may interlace, for example as in region 62 indicated in FIG. 4. Holes 46 may also interlace with holes 46' in a region, such as region 62 for example.

Figure 5:
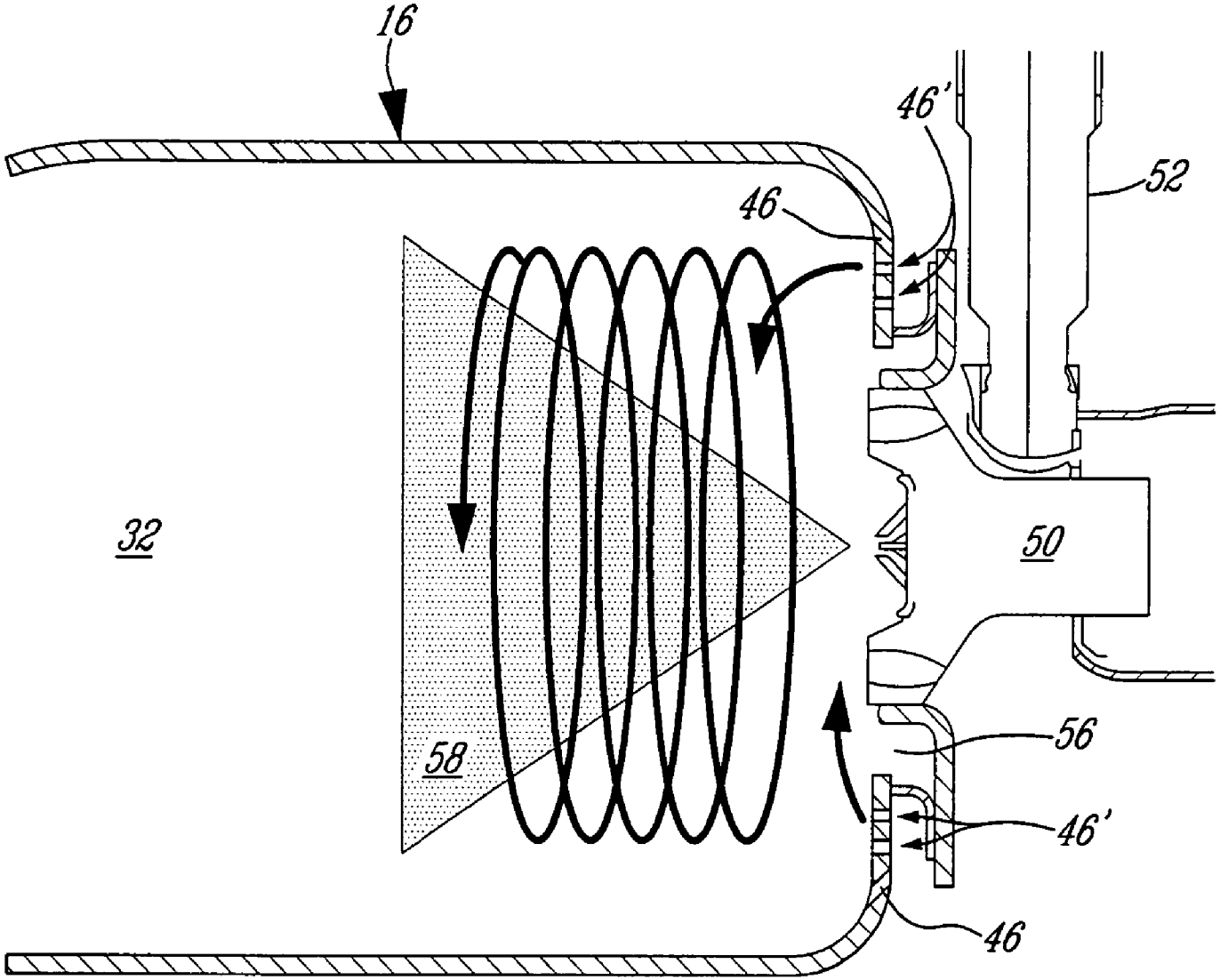
FIG. 5 is a view similar to FIG. 2, schematically depicting the device in use.
Figure 7:
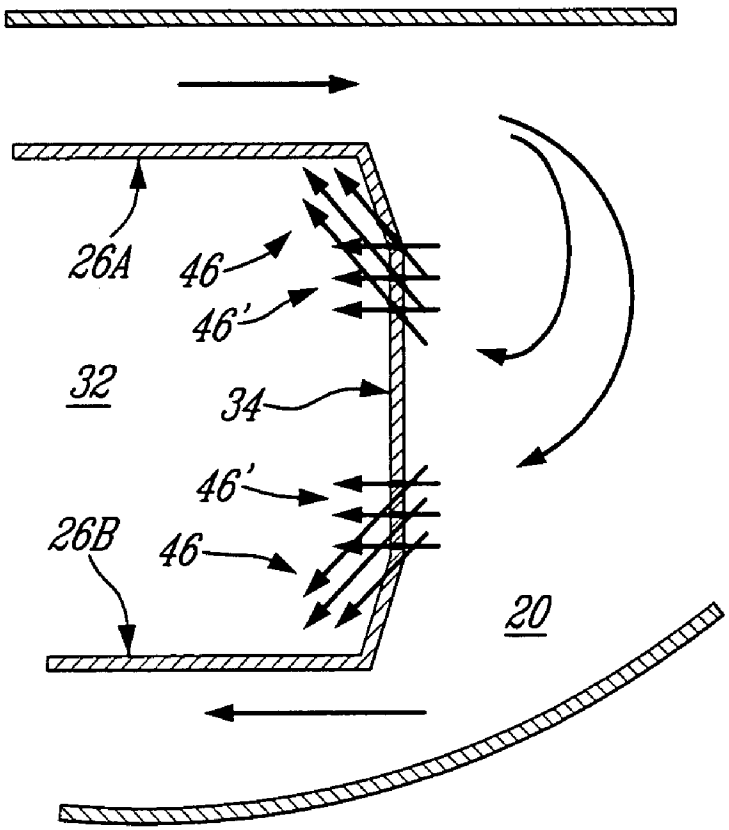
FIG. 7 is similar to FIG. 6, but showing one effect of the one aspect of the present invention.

Referring to FIG. 5, in use, air entering combustor 16 through holes 46' will tend to spiral around nozzle opening 56 in a helical fashion, and thus create a vortex around fuel spray cone 58, as will be discussed in further detail below. Holes 46' are preferably provided in the flat end portion of dome panels 34, to provide better control over the vortex created, as will also be discussed further below.

The combustor 16 is preferably provided in sheet metal, and may be made by any suitable method. Holes 44, 46, and 48 are preferably drilled in the sheet metal, such as by laser drilling. It will be appreciated in light of the description, however, that holes 48 in transition 36 are provided quite close to body panels 38A,B, and necessarily are so to provide good film cooling of body panels 38A,B. This configuration, however, makes manufacturing difficult since the drilling of holes 48 may inadvertently compromise the body panel behind this hole, and thereby result in a scrapped part. While drilling can be controlled with great precision, such precision adds to the cost of the part. According to the present invention, however, providing combustor 16 with small radius transition portions 36A,B and a flat dome permits drilling to completed less precisely and with minimal risk of damaging the adjacent body panels. This is because manufacturing tolerances for drilled holes provided on curved or conical surfaces are much larger than the comparable tolerances for drilling on a flat, planar surface. Thereby, maximizing the flat area of the combustor dome, the present invention provides an increase area over which cooling holes may be more accurately provided. This is especially critical in heat shield-less combustor designs (i.e. in which the liner has no inner heat shield, but rather the dome is directly exposed to the combustion chamber), since the cooling of the dome therefore become critical, and the cooling pattern must be precisely provided therein. By improving the manufacturing tolerances of the combustor dome, the chance of holes not completely drilled-through, or drilling damage occurring on a liner surface downstream of the drilled hole (i.e. caused by the laser or drilling mechanism hitting the liner after completing the hole) are advantageously reduced. Thus, by making the dome end flat, holes may be drilled much closed to the "corners" (i.e. the intersection between the dome and the side walls), with reduced risk of accidentally damaging the liner side walls downstream of the hole (i.e. by over-drilling). Although a flat dome, depending on its configuration, may present dynamic or buckling issues in larger-sized configurations, the very small size of a combustor for a very small gas tribune engine will in part reduce this tendency. This aspect of the invention is thus particularly suited for use in very small gas turbine engines. In contrast, conventional annular reverse-flow combustors have curved domes to provide stability against dynamic forces and buckling. However, as mentioned, this typical combustor shape presents interference and tolerance issues, particularly when providing an heat shield-less combustor dome.

Figure 6:
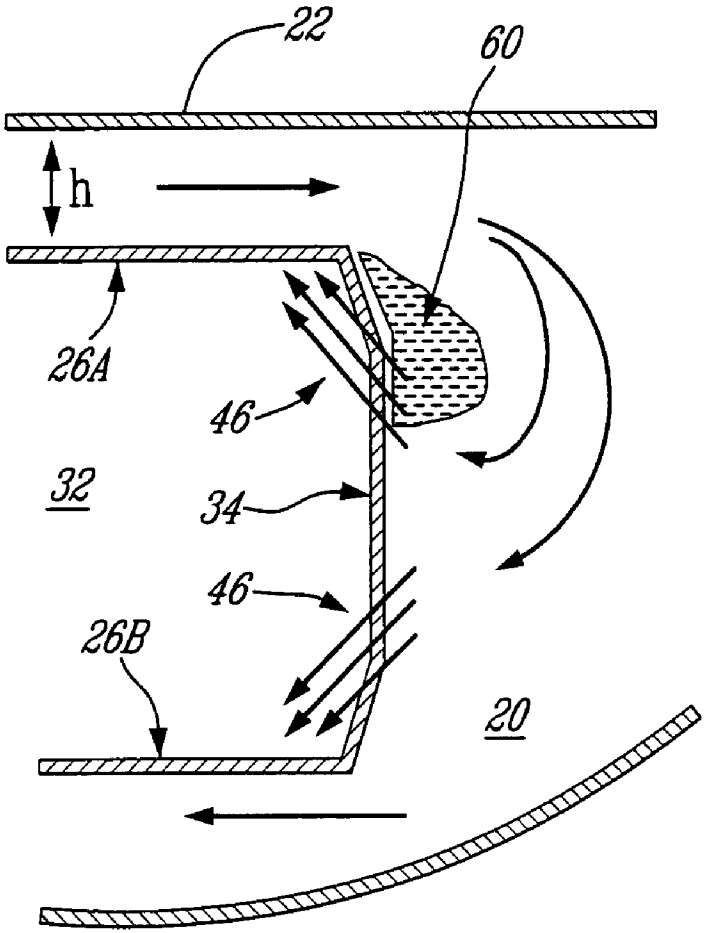
FIG. 6 is a view similar to FIG. 3, schematically depicting an aspect of the device in use.

Referring to FIG. 6, in some combustor installations, flow restrictions may exist upstream of dome 34, which may be caused, for example, by a small clearance h between case 22 and combustor 16 (in this case) and/or by the presence of airflow obstructions outside the combustor outside the combustor dome, such as (referring again to FIG. 2) the supports 52, the fuel manifold 54 and/or igniters (not shown) or other obstructions. These flow restrictions typically result in higher flow velocity between case 22 and liner 26 than is present in engines without such geometries, and these velocities are especially high around the outer liner/dome intersection, and may result in a "wake area" being generated (designated schematically by the shaded region 60), in which the air pressure will be lower than the surrounding flow. Consequently, air entering combustor 16 through effusion holes 46 adjacent wake area 60 will have relatively lower momentum (represented schematically by the relative thickness of flow arrows in FIG. 6), which negatively impacts cooling performance. This problem is particularly acute in the next generation of very small gas turbofan engines, having a fan diameter of 20 inches or less, 2500 lbs. thrust or less. Larger prior art gas turbines have the 'luxury' of a relatively larger cavity around the liner and thus may avoid such restrictions altogether. However, in very small turbofans, space is at an absolute a premium, and such flow restrictions are all but unavoidable.

Referring again to FIGS. 3 and 6, exacerbating the problem created by the wake area, in a combustor configuration where the effusion cooling holes 46 in the upper half of dome 34A are directed away from the combustor centre, air entering these holes must thus essentially reverse direction relative to the air flow outside the combustor adjacent the wake area. This further reduces the momentum of air entering in the combustion chamber in this area. Consequently, very low cooling effectiveness results adjacent this area inside the liner, and thus can undesirably permit the flame to stabilize close to the combustor outer wall. This results in the upper half of the dome and combustor outer liner being very hot compared to bottom half/inner liner, since the dome cooling holes in this portion of the combustor have the same general direction as the air flow in plenum 22.

To address this problem, the cooling hole pattern of the present invention improves the flow in the wake area by reducing the overall drag coefficient ($C_d$) in the wake area by providing holes 46' in addition to holes 46, and thus permitting more direct entry of air into the combustor (since holes 46' are not angled as harshly relative to the primary flow in plenum 20, and thus air may enter combustor 16 at a higher momentum though holes 46' than through holes 46. This higher momentum air exiting from holes 46' assists holes 46 in pushing away fuel from the liner walls to impede flame stabilization near the wall liner wall.

Perhaps more importantly, however, the spiral or helical flow also helps to constrain the lateral extent of fuel spray cone 58. Referring again to FIG. 5, as mentioned above the pattern of holes 46' causes air inside the liner to spiral or spin in a vortex around the fuel nozzle and away from dome 34 and into combustion chamber 32. This helps keep the fuel spray away from dome panel 34 as well as the upstream portions of the outer and inner liner panels adjacent to the dome by narrowing the width of the fuel spray cone. Although the skilled reader will appreciate that the size of fuel spray cone 58 can also be controlled by the nozzle characteristics (e.g. the spray cone can be narrowed by using more air in the nozzle swirler, or providing a nozzle having a narrower nozzle cone), such nozzle-based modes of control are less preferable than the present solution, since the present invention makes use of cooling air already in use to cool the combustor wall (which permits improved efficiency over using increase guide air), and permits a shorter combustor length since a narrower spray generated from the nozzle swirler will require a longer combustor liner or otherwise cause burning of the LED 40A by fuel impingement of fuel thereon. Thus, the present invention facilitates both efficiency and size reduction improvements.

The spiral flow inside the liner also provides better fuel/air mixing and thus also improves the re-light characteristic of the engine, because the spiral flow 'attacks' the outer shell of the fuel spray cone, which is consists of the lower density of fuel particles, and thus improves fuel-air mixing in the combustion chamber.

As a result of the hole pattern of the present invention, a novel combustor air flow pattern results. Conventionally, combustor internal aerodynamics provide either single torroidal or double torroidal flows inside the liner, however the present invention results in new aerodynamic pattern due to spiral flow introduced inside the liner.

The present invention is believed to be best implemented with a combustor having a flat dome panel. Although the invention may also be applied to conical, curved or other shaped dome panels, it is believed that the spiral flow which is introduced inside the liner will be inferior to that provided by the present hole pattern in a flat dome panel.

The above description is meant to be exemplary only, and one skilled in the art will recognize that further changes may be made to the embodiments described without departing from the scope of the invention disclosed. For example, the invention may be provided in any suitable annular combustor configuration, and is not limited to application in turbofan engines. It will also be understood that holes 46' need not be provided in a concentric circular configuration, but in any suitable pattern. Holes 46 and 46' need not be provided in distinct regions of the dome 34, and may instead be interlaced in overlapping regions. Holes 46' around adjacent nozzle openings 56 may likewise be interlaced with one another. The direction of vortex flow around each nozzle is preferably in the same direction, though not necessarily so. Each nozzle does not require a vortex, though it is preferred. Although the use of holes for directing air is preferred, other means such as slits, louvers, etc. may be used in place of or in addition to holes. Still other modifications will be apparent to those skilled in the art, in light of a review of this disclosure, and such modifications are intended to fall within the appended claims.

We claim:

1. A gas turbine engine combustor comprising a liner enclosing a combustion chamber, the liner including a dome portion at an upstream end thereof, the dome portion having defined therein a plurality of openings each adapted to receive a fuel nozzle and a plurality of holes defined around each opening, each opening having an axis generally aligned with a fuel injection axis of a fuel nozzle received by the opening, a helical flow path being defined by the holes which extend through the dome portion at an angle tangential to an associated one of said openings, the holes directing air into the combustion chamber in a spiral pattern around the axis of the associated one of said openings corresponding to said helical flow path.

2. The combustor of claim 1 wherein the holes are defined substantially circumferentially around the openings.

3. The combustor of claim 1 wherein the holes are defined concentrically around the axis of its associated opening.

4. The combustor of claim 1 wherein the holes are defined in a plurality of rows around at least one opening.

5. The combustor of claim 4 wherein the rows are concentric with one another.

6. The combustor of claim 1 wherein the combustor includes a region wherein at least some holes associated with one opening are interlaced with at least some holes associated with another opening.

7. The combustor of claim 1 wherein the combustor includes a region wherein at least some holes associated with one opening are interlaced with a second set of holes, said second set adapted to direct a non-spiralling flow of air into the combustor.

8. The combustor of claim 1 wherein the holes are angled to admit air into the combustor generally tangentially relative to the opening.

9. The combustor of claim 1 wherein the holes are adapted to direct air into a vortex of sufficient strength to, in use, constrain a lateral extent of fuel entering the combustor via said fuel nozzles.

10. The combustor of claim 1 wherein the openings and holes are provided in a portion of the dome portion which is substantially perpendicular to the axis.

11. The combustor of claim 1 wherein the openings and holes are provided in a generally planar portion of the dome portion.

12. A gas turbine engine combustor comprising a liner enclosing a combustion chamber, the liner having defined therein a plurality of openings each adapted to receive a fuel nozzle for directing fuel into the combustion chamber generally along an axis of the opening, the liner also having means associated with each opening for directing air into the combustion chamber in a spiral pattern around an axis of the associated opening, said means for directing air including a helical flow path defined by a plurality of holes which extend through the liner at an angle tangential to the associated opening.

13. The combustor of claim 12 wherein the means for directing air comprises means for directing said air into the combustion chamber generally tangentially relative the associated opening.

14. The combustor of claim 12 wherein the means for directing air is disposed substantially around each of said openings.

15. The combustor of claim 12 wherein the means for directing air is disposed concentrically with each of said openings.

16. The combustor of claim 12 wherein the means for directing air is disposed substantially perpendicularly to the axis.

17. The combustor of claim 12 wherein the means for directing air is provided in a generally planar portion of the liner.

18. The combustor of claim 12 wherein said means includes a plurality of holes defined through the liner in a circular pattern about each said opening, the holes defining a plurality of rows which are concentric with one another about the opening.

* * * * *